US006281914B1

(12) United States Patent
Hiwada et al.

(10) Patent No.: US 6,281,914 B1
(45) Date of Patent: Aug. 28, 2001

(54) INK JET-TYPE PRINTER DEVICE WITH PRINTER HEAD ON CIRCUIT BOARD

(75) Inventors: Shuhei Hiwada, Toyoake; Motoshi Kishi, Nagoya; Manabu Yoshimura, Nagoya; Koji Imai, Nagoya, all of (JP)

(73) Assignee: Brother Kogyo Kabushiki Kaisa, Nagoya (JP)

( * ) Notice: Subject to any disclaimer, the term of this patent is extended or adjusted under 35 U.S.C. 154(b) by 0 days.

(21) Appl. No.: 08/942,907

(22) Filed: Oct. 2, 1997

(30) Foreign Application Priority Data

| | | |
|---|---|---|
| Nov. 13, 1996 | (JP) | 8-301464 |
| Feb. 7, 1997 | (JP) | 9-040125 |
| Feb. 10, 1997 | (JP) | 9-041624 |
| Feb. 10, 1997 | (JP) | 9-041626 |
| Feb. 10, 1997 | (JP) | 9-041627 |
| Aug. 28, 1997 | (JP) | 9-232567 |

(51) Int. Cl.[7] ..... B41J 2/14; B41J 2/16
(52) U.S. Cl. ..... 347/50
(58) Field of Search ..... 347/50, 42, 49, 347/63, 69

(56) References Cited

U.S. PATENT DOCUMENTS

| | | | | |
|---|---|---|---|---|
| 4,500,895 | * | 2/1985 | Buck et al. | 347/87 |
| 4,908,638 | * | 3/1990 | Albosta et al. | 347/43 |
| 4,940,998 | * | 7/1990 | Asakawa | 347/50 |
| 5,278,584 | * | 1/1994 | Keefe et al. | 347/63 |
| 5,469,199 | * | 11/1995 | Allen et al. | 347/42 |
| 5,625,395 | * | 4/1997 | Imai | 347/69 |
| 5,684,518 | * | 11/1997 | Nobel et al. | 347/50 |

FOREIGN PATENT DOCUMENTS

| | | |
|---|---|---|
| 6-328684 | 11/1994 | (JP) . |
| 7-304168 | 11/1995 | (JP) . |

* cited by examiner

*Primary Examiner*—John Barlow
*Assistant Examiner*—MIchael S. Brooke
(74) *Attorney, Agent, or Firm*—Oliff & Berridge, PLC

(57) ABSTRACT

In an ink jet-type printer device, a printer head has ink passages and actuators for jetting ink from the ink passages. An integrated circuit for driving the actuators and its leading electrodes having respective connecting terminals are provided on the printer head. A printed circuit plate has an electric wiring pattern having connecting terminals which correspond to the connecting terminals on the printer head. The printer head is attached to the printed circuit plate by an adhesive with its connecting terminals being made to contact with the corresponding connecting terminals on the printed circuit plate. The printed circuit plate is assembled to a carriage integrally with the printer head.

18 Claims, 13 Drawing Sheets

INK JET-TYPE PRINTER DEVICE WITH PRINTER HEAD ON CIRCUIT BOARD

CROSS REFERENCE TO RELATED APPLICATION

This application incorporates herein by reference Japanese Patent Applications No. 08-301064, No. 09-40125, No. 09-41624, No. 09-41626, 09-41627 and No. 09-232567 filed on Nov. 13, 1996, Feb. 7, 1997, Feb. 10, 1997, Feb. 10, 1997, Feb. 10, 1997 and Aug. 28, 1997, respectively.

BACKGROUND OF THE INVENTION

1. Field of the Invention

The present invention relates to an ink jet-type printer device and, in particular, to an ink jet-type printer device which enables simultaneous assembling and electrical connection of its printer head for jetting ink with its printed circuit plate and simplifies a mounting work of the printer head and the printed circuit plate onto its printer body.

2. Description of Related Art

As a conventional ink jet-type printer device which jets ink for information printing from ink jet nozzles, an on-demand type which can be made compact in size and perform a high speed printing operation is used. This type particularly uses a piezoelectric element or a heater for generating an ink jetting pressure by deforming the piezoelectric element or by vaporizing the ink, respectively.

The ink jet-type printer device using the piezoelectric element for the pressure control includes a plurality of ink passages for passing the ink therethrough from an ink supply source, a plurality of partition walls comprising the piezoelectric elements defining the ink passages, and a printer head having a plurality of electrodes provided on the side faces of the partition walls. With a driving signal from an integrated circuit (IC) including a driving circuit therein being applied to the electrodes of the partition walls corresponding to the ink passage for jetting the ink, the adjacent two of the partition walls deform by shearing to vary the volume of the ink passage, so that the ink in the ink passage jets from the jet nozzle provided at the top end of the ink passage.

In one exemplary ink jet-type printer device for two-color printing shown in FIG. 22, each of printer heads 135 and 136 has a head plate 140 made of a piezoelectric material including a plurality of ink passages therein, a cover plate 147 fixedly attached to cover the ink passages and an ink inlet pipe 148 for supplying the ink from an ink supply source into the ink passages. The printer heads 135 and 136 are fixedly mounted on a carriage 121 by various fixing members (not shown). A printed circuit plate 132 supporting thereon ICs 149 which include driving circuits therein is also fixed on the carriage 121. The printed circuit plate 132 is formed with wiring patterns 154 connected to the ICs 149. Each cover plate 147 is formed with a plurality of leading electrodes 150 which supply electric power to actuators (not shown) provided in correspondence with the ink passages. The leading electrodes 150 and the terminals of the wiring patterns 154 are electrically connected by flexible printed circuit plates (FPC) 110.

According to the ink jet-type printer device shown in FIG. 22, as the printer heads 135 and 136 must be attached to the carriage 121, various fixing members as well as fixing work are required. Further, as the terminals of each wiring pattern 154 formed on the printed circuit plate 132 and the leading electrodes 150 formed on each printer head 147 must be connected electrically through a number of signal lines of the FCC 110 formed in correspondence with the ink passages, the electrical connection of the signal lines on FCC 110 with the corresponding leading electrodes 150 and the wiring pattern 154 is complicated.

In the case where a plurality of printer heads are provided for the color-printing, in particular, the printer heads 135 and 136 must be spaced apart from each other to mount each FPC 110 therebetween. This arrangement results not only in enlarging the size of a printer device but also in a complicated work for accurately fixing the positions of jet nozzles of the printer heads.

In addition, it is also known by JP-A 6-328684 and JP-7-304168 to attach partly by an adhesive the rear end part of a printer head to a printed circuit plate fixed to a carriage and to connect electrically leading electrodes formed on a piezoelectric-type printer head to a wiring pattern formed on a printed circuit plate by corresponding conductive leading wires.

According to this ink jet-type printer device, as the printing head is held fixed to the printed circuit plate only partly at its rear end part, not only the fixing work is required but also fixing strength is likely to become insufficient. Further, the electrical connection of the leading electrodes to the wiring pattern on the printed circuit plate results in a complicated electric wiring arrangement.

SUMMARY OF THE INVENTION

It is therefore an object of the present invention to provide an ink jet-type printer device which requires a simplified assembling and electrical connecting work.

It is a further object of the present invention to provide an ink jet-type printer device which enables an electric connection for a power supply between its printed circuit plate and a plurality of ink-jetting actuators of its printer head at the same time as assembling the printed circuit plate and the printer head.

It is a still further object of the present invention to provide an ink jet-type printer device which requires a simplified work for assembling its printer head and a printed circuit plate to a printer body.

According to the present invention, a printer head having a plurality of ink passages and a plurality of actuators for the respective ink passages are fixedly attached to a printed circuit plate. The printer head has connecting terminals for supplying electric signals for selectively driving the actuators, while the printed circuit plate has connecting terminals which are the same in number with the connecting terminals of the printer head. The connecting terminals of the printer head and the printed circuit plate are formed in position to contact each other when the printer head is attached to the printed circuit plate.

Preferably, a driving circuit for converting a serial input into a parallel output is mounted on the printer head so that the number of the connecting terminals on the printer head is reduced, or on the printed circuit plate.

More preferably, the printer head has a box-like manifold made of a good thermal conductivity for distributing the ink into the ink passages, and the driving circuit is mounted on the manifold with the connecting terminals of the printer head being formed thereon.

More preferably, the printed circuit plate has inkjetting nozzles in communication with the ink passages of the printer head.

More preferably, the printed circuit plate is made of a flexible sheet having the ink jetting nozzles.

BRIEF DESCRIPTION OF THE DRAWINGS

Other objects, features and advantages of the present invention will become more apparent from the following detailed description when read with reference to the accompanying drawings, in which.

DETAILED DESCRIPTION OF THE PREFERRED EMBODIMENTS

The present invention will be described in detail with reference to various embodiments and modifications thereof which are directed to color ink-jet type printer device for printing colored images by jetting four color inks (cyan, magenta, yellow and black).

First Embodiment

Figure 1:
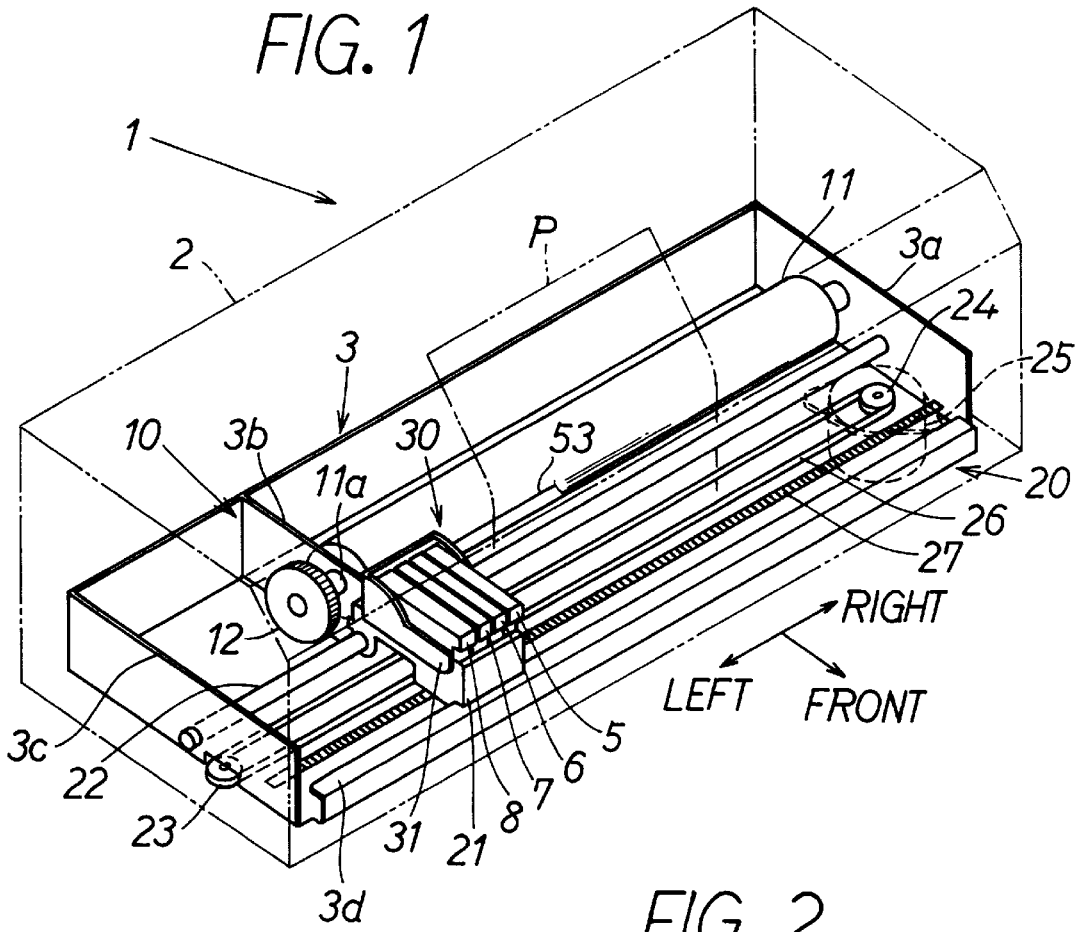
FIG. 1 is a perspective view showing schematically the internal construction of a color ink jet-type printer device according to the first embodiment of the present invention.

As shown in FIG. 1, a color ink jet-type printer device 1 has primarily a paper feeding mechanism 10 including a rubber platen 11 and a frame 3 provided within a cover 2, a carriage driving mechanism 20 for driving a carriage 21 to move, and an ink jetting mechanism 30 for printing colored images on a paper P. Ink cartridges 5 through 8 which store four color inks (cyan, magenta, yellow and black) therein respectively are detachably mounted in a head holder 31 fixed to a carriage 21.

In the paper feeding mechanism 10, the platen 11 is arranged to extend laterally (in the right-left direction in the figure) with its platen shaft 11a being supported rotatably by side wall plates 3*a* and 3*b* of the frame 3 at both axial ends. A platen gear 12 attached to the axial end (left end) of the platen shaft 11*a* s held rotatably by a paper feeding motor through a gear mechanism (not shown) to rotate the platen 11 in a paper feeding direction.

In the carriage driving mechanism 20, the carriage 21 is disposed horizontally in front of and in parallel with the platen 11. The carriage 21 is supported movably in the lateral direction on a guide rail 3*d* of the frame 3 and a guide rod 22 fixed to the side wall plates 3*a* and 3*c* of the frame 3.

A driving pulley 24 attached to the shaft of a carriage driving motor 25 is disposed at the rightmost position of the moving range of the carriage 21, while a driven pulley 23 is rotatably supported by the side wall plate 3*c* at the leftmost position of the movable range of the carriage 21. The driven pulley 23 is operatively coupled to the driving pulley 24 through. an endless timing belt 26 to which the carriage 21 is fixed for movement therewith. With the rotation of the carriage driving motor 25, the carriage 21 is moved by the pulleys 23 and 24 and the timing belt 26 reciprocally in parallel with the paper P on the platen 11 while being guided by the guide rod 22 and the guide rail 3*d*.

Figure 2:
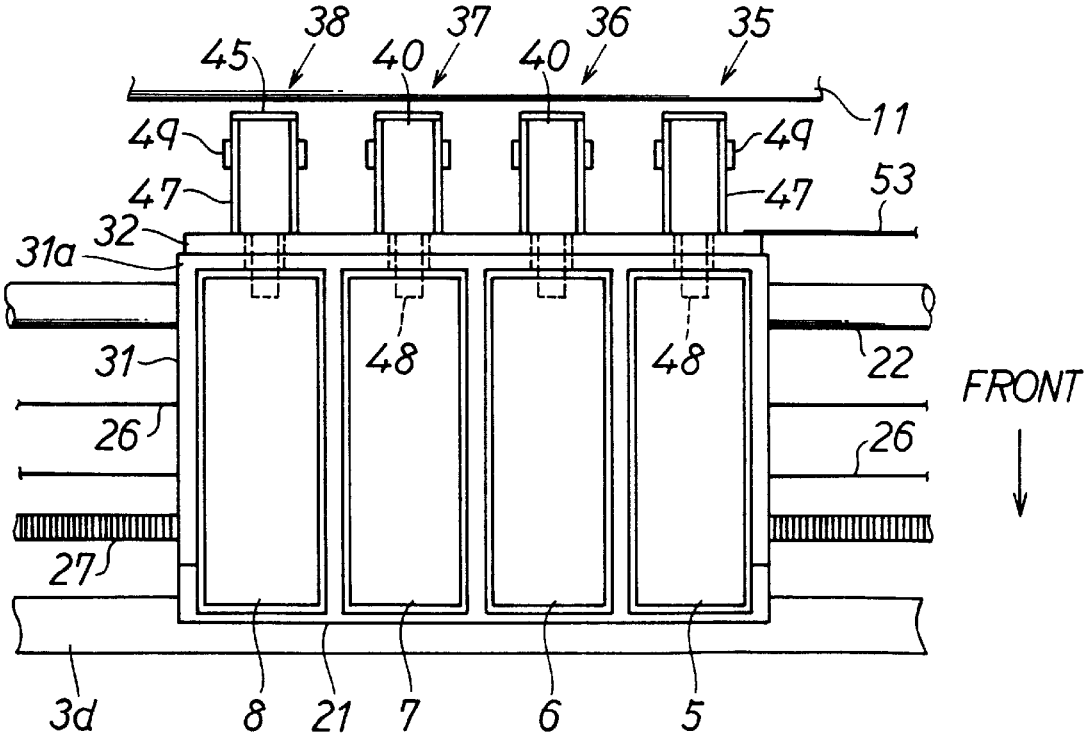
FIG. 2 is an enlarged plan view showing a carriage and an ink jet mechanism in the first embodiment.

As shown in FIG. 2, an encoder member 27 is disposed to extend laterally and horizontally underside the carriage 21 and attached to the side wall plates 3*a* and 3*c* at the lateral or axial ends thereof. The encoder member 27 is made of a striplike thin film printed with a number of fine lines in black at every small lateral interval. A photo sensor (not shown) comprising a light emitter and a light receiver is attached to the underside of the carriage 21 to face the encoder member 27 so that the photo sensor detects the moving position of the carriage 21.

In the ink jetting mechanism 30, the head holder 31 mounted on the carriage 21 is in a box-like shape and has an open upper and front sides. A printed circuit plate 32 is attached to the rear face of the rear vertical wall 31*a* of the head holder 31 in parallel with the paper P. Ink jet-type printer heads 35 through 38 for jetting the cyan, magenta, yellow and black inks, respectively are fixedly mounted on the printed circuit plate 32, and the four ink cartridges 5 through 8 are detachably coupled to the corresponding printer heads 35 through 38. Thus, the printer heads 35 through 38 are attached to the carriage 21 integrally and compactly.

As the printer heads 35 through 38 have the same constructions to each other, the further description to follow is made with reference to one printer head 35.

Figure 3A:
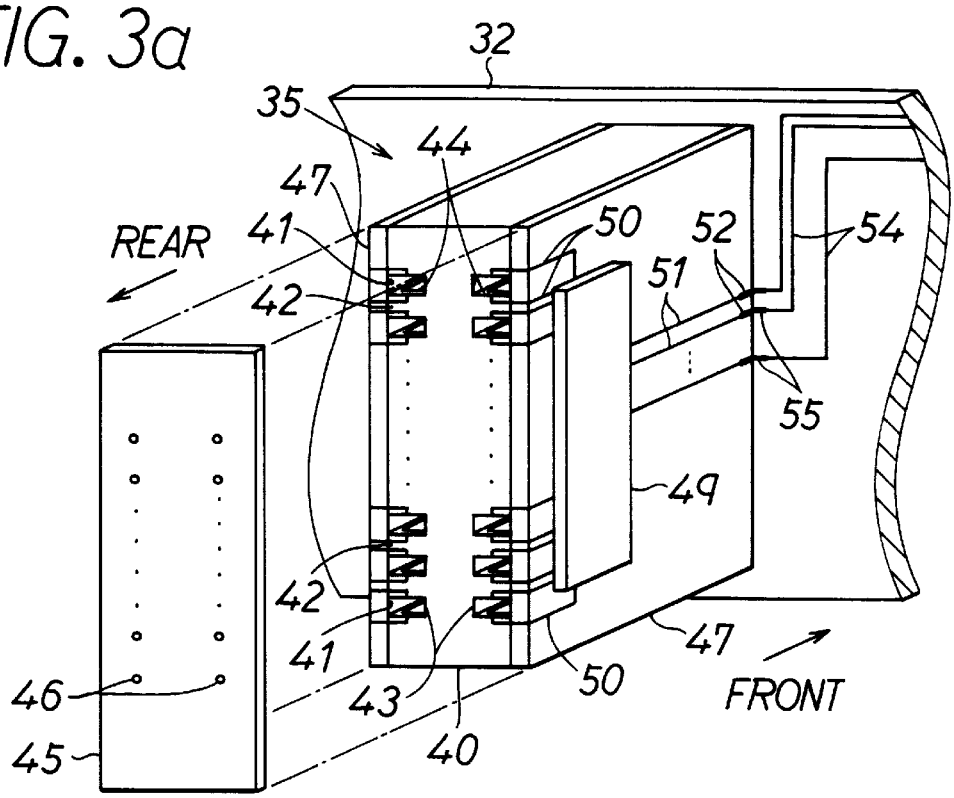
FIG. 3*a* is a perspective view showing a printer head and a printed circuit plate in the first embodiment.
Figure 4:
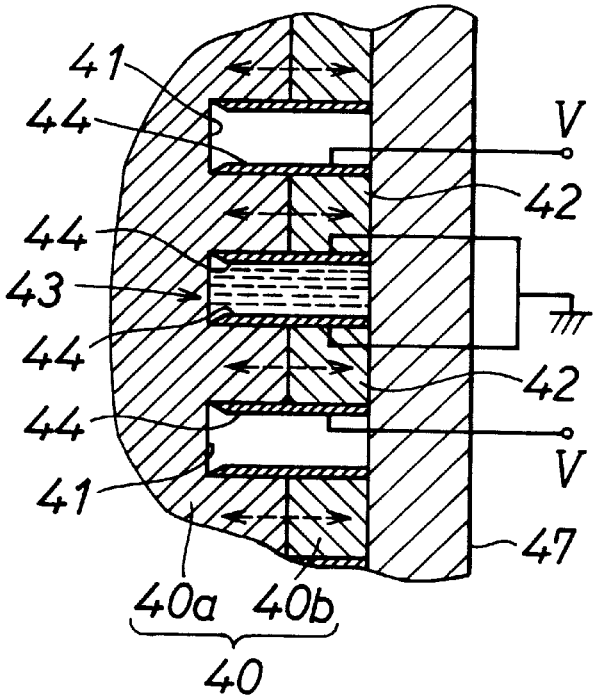
FIG. 4 is a cross sectional view showing in enlargement a part of the printer head in the first embodiment.

As shown in FIGS. 3*a* and 4, the printer head 35 is constructed generally by a thin base plate 40 made of a piezoelectric material such as a piezoelectric ceramics and by a pair of thin ceramics cover plates 47 fixedly attached to both side faces of the base plate 40 by an adhesive.

The base plate 40 has, at its both right and left side faces, a plurality of parallel narrow grooves 41 each of which is defined by adjacent two of a plurality of parallel partition walls 42 extending from the front side to the rear side longitudinally at every short interval in a vertical direction. These longitudinal openings of the narrow grooves 41 are covered by the cover plate 47. Thirty-two ink passages 43 are provided for ink storage at every two narrow grooves 41. The remaining narrow grooves 41 and the uppermost and the lowermost ones are held empty without ink. As understood from FIG. 4, the base plate 40 is constructed by a stack of layers 40*a* and 40*b* which are polarized oppositely to each other as indicated by dot-and-chain arrows.

The printer head 35 further has, on the rear side faces of the base plate 40 and the pair of cover plates 47, a nozzle plate 45 made of a synthetic resin and having a pair of rows of a plurality of ink jetting nozzles 46. The nozzles 46 are formed in correspondence with the thirty-two ink passages 43. On the front side a manifold 48 (FIG. 2) is attached to distribute the ink from the ink cartridge 5 into the ink passages 43.

On both upper and lower side faces of each partition wall 42, a pair of electrodes 44 are fixed along the entire longitudinal length of the partition wall 42. The partition walls 42 defining each ink passage 43 and its electrodes 44 function as an actuator.

As understood from FIG. 3*a*, an actuator driving integrated circuit (IC) 49 is mounted on the outer side surface of the cover plate 47 with its output terminals being connected to the plurality of electrodes 44 through a plurality of corresponding leading electrodes 50 formed on the outside surface of the cover plate 47. A plurality of input terminals of the driving IC 49 are connected to a plurality of corresponding leading electrodes 51 formed on the outside surface of the cover plate 47. The leading electrodes 51 have respective connecting terminals 52 at the front ends thereof. The leading electrodes 50 and 51 are formed by electrically plating a film of metal such as silver on the outside surface of the cover plate 47 and then removing unnecessary parts of the metal film by laser light projection or etching process. This arrangement of the driving IC 49, leading lines 50, 51 and the connecting terminals 52 are provided on both cover plates 47 so that each arrangement corresponds to one of the rows of the actuators. Thus, the leading electrodes 50 and 51 for electric wiring between the driving IC 49 and a number of actuators are provided by the best use of the widest planar surface of the cover plate 47, so that the leading electrodes 50 and 51 may be spaced apart sufficiently from the adjacent ones assuring the electric insulation therebetween.

The printed circuit plate 32 is made of a rigid material and has thereon a wiring pattern 54 which is formed by pattern printing or by plating a thin film of metal and then etching to remove the unnecessary parts of the metal film. The wiring pattern 54 is connected to a flexible printed circuit plate (FPC) 53 which is in turn connected to a printer control circuit (not shown) for producing a jet driving signal and a control signal, each comprising a serial data, for printing in a dot-matrix form. The wiring pattern 54 has at pattern ends thereof a plurality of connecting terminals 55 which are to be located correspondingly to the connecting terminals 52 of the printer head 35 when the printer head 35 is attached to the printed circuit plate 32 in position.

The printer head 35 is fixed to the printed circuit plate 32 by pasting an epoxy adhesive over the front side surface (opposite to the nozzle plate 45) of the printer head 35 and then attaching it to the pasted surface of the printed circuit plate 32 in a manner that the connecting terminals 52 and the connecting terminals 55 are placed in position to contact with each other. Thus, assembling the printer head 35 with the printed circuit plate 32 and electrically connecting the connecting terminals 52 and 55 are attained at the same time in a very simplified process. For assuring the electric connections, the connecting terminals 52 and 55 are brazed to each other by the use of a solder. Other connecting materials such as a silver paste or an anisotropic conductive film may be used in place of the solder as well.

Alternatively, the connecting terminals 52 of the printer head 35 may be extended toward the front side to be bent into L-shaped ends which will be laid over the connecting terminals 55 of the wiring pattern 54. In this instance, the connecting terminals 52 and 55 are connected to each other by the reflow process in which a brazing material such as a creamy solder is attached to the connecting terminals 52 and 55 and then the brazing material is heated to melt. The brazing material used must have a melting temperature point below the Curie point so that heating the brazing material may not degrade the polarization of the piezoelectric material. The brazing process is preferably completed within a short time period so that the polarization may not be degraded even when the heating temperature rises to exceed the Curie point.

In assembling the printer heads 35 through 38 fixedly onto the single printed circuit plate 32, the printer heads 35 through 38 are aligned in parallel with respective side surfaces having the leading electrodes 50, 51 and the connecting terminals 52 thereon being placed closely to face the adjacent one to each other. Thereafter, while maintaining the positions of the nozzles 46 of the printer heads 35 through 38 by a jig or the like, all the printer heads 35 through 38 are bonded to the printed circuit plate 32 at once by the adhesive and the solder. Required bonding strength may be assured by the brazing only. Alternatively, by forming the connecting terminals 55 at the right positions accurately relative to each printer head, the printer heads 35 through 38 may be fixed in position because the connecting terminals 52 and 55 will pull each other by the surface tension of the brazing material once melted and solidified.

Figure 3B:
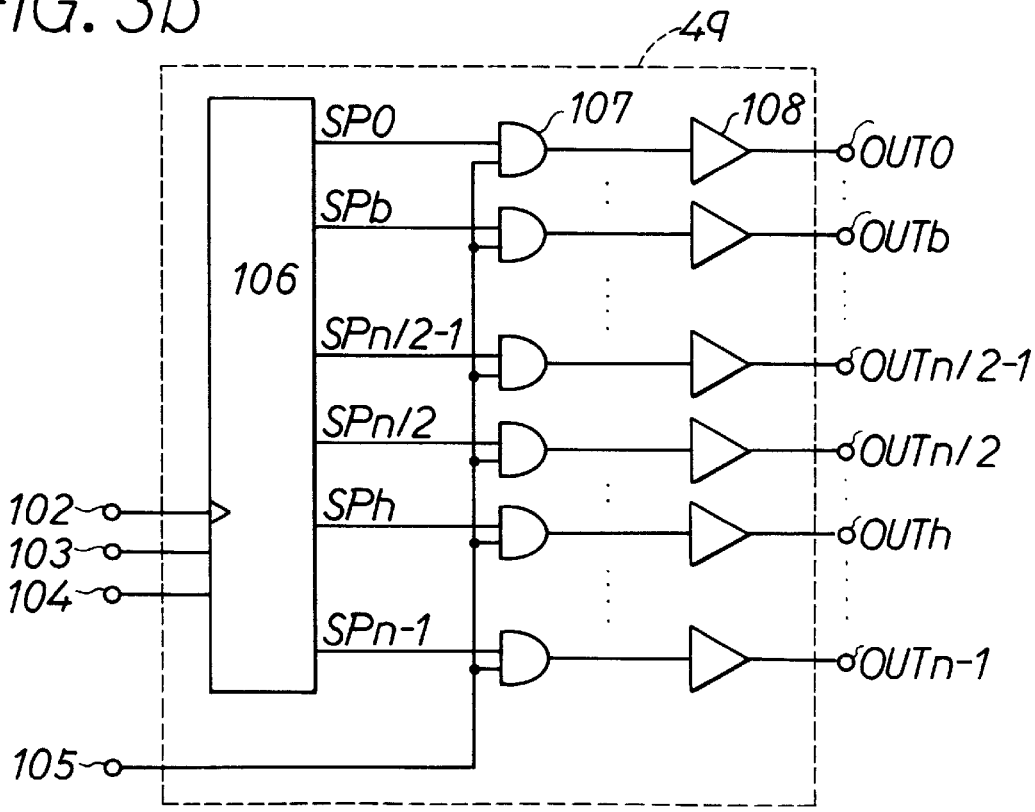
FIG. 3*b* is a circuit diagram showing a driving IC shown in FIG. 3*a;*

The FPC 53 and the wiring pattern 54 each has electrically conductive lines, that is, a clock line, a data line, printing timing signal line, a latch signal line, a voltage supply line and a ground line. As shown in FIG. 3*b*, the driving IC 49 includes a serial-parallel converter 106, AND gates 107, and buffer amplifiers 108. The converter 106 converts printing data transmitted serially through the data line 103 into parallel signals. That is, in synchronism with the clock signals on the clock line 102, it receives the data on the data line 103 and shifts the received data sequentially from output SPO to SPn−1. After receiving the data which correspond in number to the ink passages, it latches its outputs SP (SPO through SPn−1) in response to the latch signal on the latch signal line 104. The AND gates 107 passes the outputs SP of the serial-parallel converter 106 to the buffer amplifiers 108 in response to the timing signal on the timing signal line 105 thereby to apply the supply voltage (driving signal) on the voltage supply line to the electrodes 44 on the ink passage to be driven. Other details in construction and operation of the driving IC 49 may be understood with reference to Imai U.S. Pat. No. 5,625,395, the disclosure of which is incorporated herein by reference.

Figure 5:
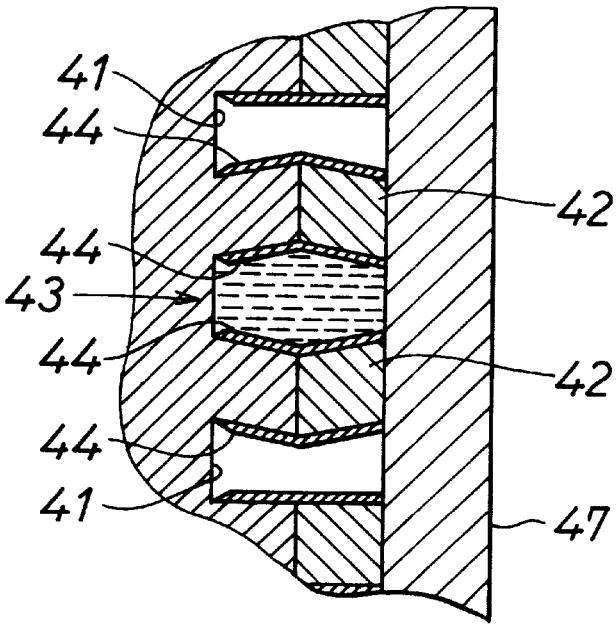
FIG. 5 is a cross sectional view showing an operation of the printer head shown in FIG. 4.

In case the driving signal is applied across a pair of the straight partition walls 42 through the electrodes 44 as shown in FIG. 4, the pair of partition walls 42 deform by shearing and incline to expand the volume of the ink passage 43 as shown in FIG. 5. When the driving signal disappears thereafter, the partition walls 42 restores its original straight shape shown in FIG. 4 jetting the ink in the ink passage 43 between the pair of the partition walls 42 through the corresponding one of the nozzles 46.

As described above, not only the driving IC 49 is mounted on the printer head 35, but also a number of leading electrodes 50 of the driving IC 49 for supplying the driving signal to the electrodes 44, four leading electrodes 51 of the driving IC 49 and four connecting terminals 52 are formed on the printer head 35. In addition, the wiring pattern 54 having four connecting terminals 55 in correspondence with the connecting terminals 52 are formed on the printed circuit plate 32 which the printer head 35 is fixed to. As a result, fixing the printer head 35 with the printed circuit plate 32 and electrically connecting the connecting terminals 52 with the connecting terminals 55 are attained simultaneously in the simplified manner by only aligning the connecting terminals 52 and 55 and attaching the printer head 35 pasted with the adhesive on its front side surface, while assuring a sufficient bonding strength therebetween.

Further, as no FPC is required between the printer heads 35 through 38 and the printed circuit plate 32, the printer heads 35 through 38 may be juxtaposed closely to each other enabling the reduction in size of the entire device. In addition, as the driving IC 49 which works as a serial-to-parallel signal converter is mounted on the printer head 35, the number of connecting terminals between the printer head 35 and the printed circuit plate 32 and between the printed circuit plate 32 and the FPC 53 may be reduced to much less than that of the electrodes 44 thus enhancing the reliability of the electric connecting work.

Still further, as the driving IC 49 is mounted on the printer head 35, the heat generated by the IC 49 during the ink jetting operation control can be transferred effectively to the printer head 35. Thus, this transferred heat not only heats the ink in the ink passage 35 located closely to the driving IC 49 to a temperature more appropriate for the ink jetting but also dissipates from the printer head 35 or with the jetted ink.

(Modifications of the First Embodiment)

Figure 6A:
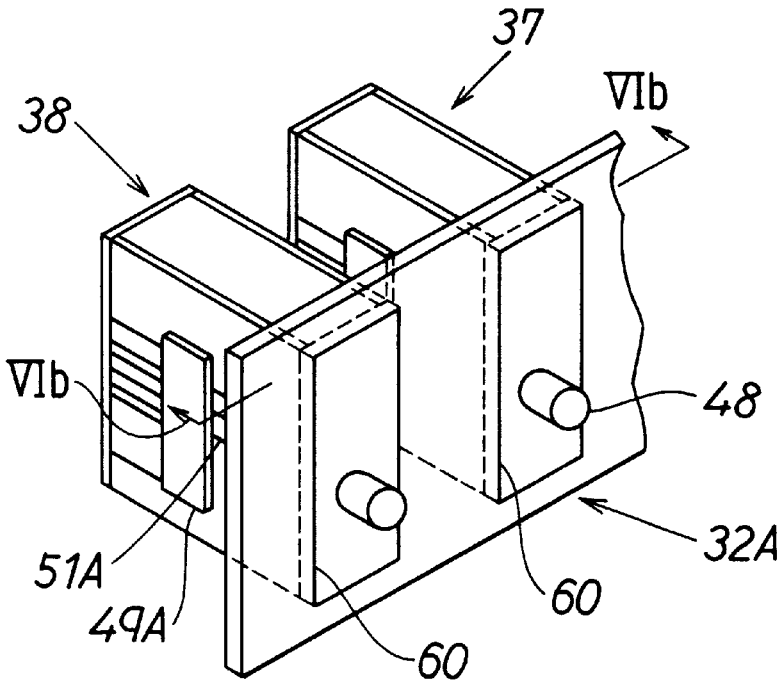
FIGS. 6*a* and 6*b* are a perspective view showing a printer head and a printed circuit plate according to a modification of the first embodiment and a cross sectional view showing the same taken along the line VIb in FIG. 6*b;*
Figure 6B:
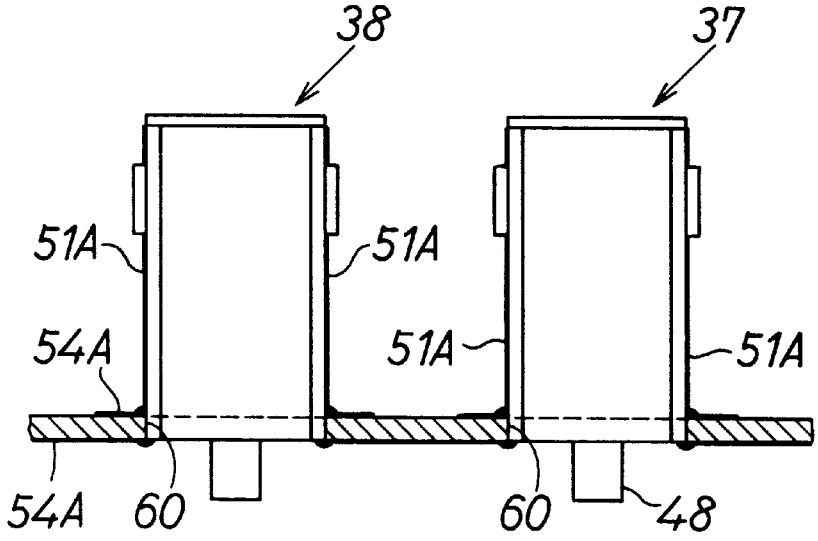

(A) The first embodiment may be modified in that, as shown in FIGS. 6A and 6B, a printed circuit plate 32A has rectangular fitting holes 60 for tightly supporting the printer heads 37 and 38 therein at the front or intermediate portions of the printer heads 37 and 38. Leading electrodes 51A connected to a driving IC 49A and wiring patterns 54A formed on both sides of the printed circuit plate 32A are connected by brazing. This arrangement not only strengthen further the fixing of the printer heads 37 and 38 with the printed circuit plate 32A but also simplify the positioning of the printer heads 37 and 38 on the printed circuit plate 32A.

Figure 7:
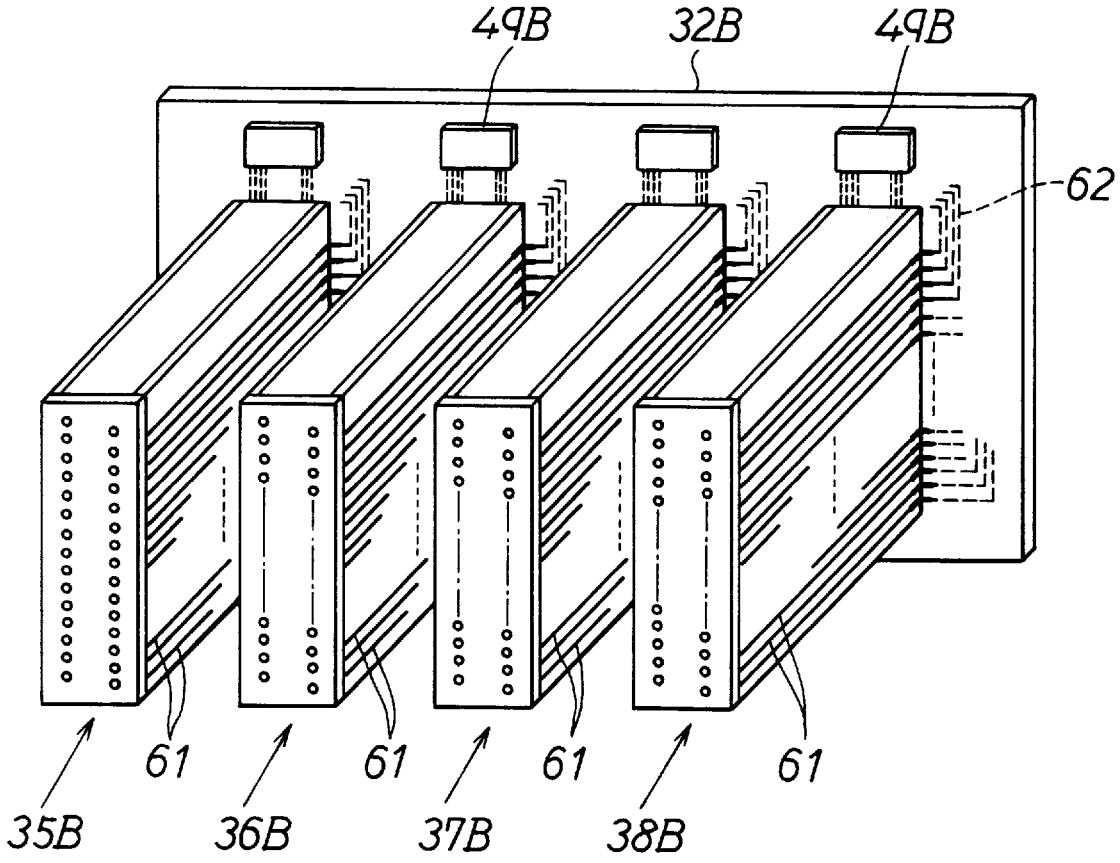
FIG. 7 is a perspective view showing a printer head and a printed circuit plate according to another modification of the first embodiment.

(B) The first embodiment may be modified further in that, as shown in FIG. 7, driving ICs 49B are mounted on a printed circuit plate 32B. A number of leading electrodes 61 having respective connecting terminals are formed for the corresponding electrodes on both sides of each of printer heads 35B through 38B. Wiring patterns 62 each connected to the corresponding driving ICs 49B and having the same number of signal lines as the corresponding leading electrodes 61 are formed on the printed circuit plate 32B and connected to the leading electrodes 61. The printer heads 35B through 38B are fixed to the printed circuit plate 32B by an adhesive or brazing.

In this modification, the driving ICs 49B may be mounted on the printed circuit plate 32B which can provide a sufficient mounting space in accordance with the size of the driving IC. In case that each driving IC 49B is designed to drive a plurality of printer heads, the wiring patterns 62 on the printed circuit plate 32B may be simplified.

Figure 8:
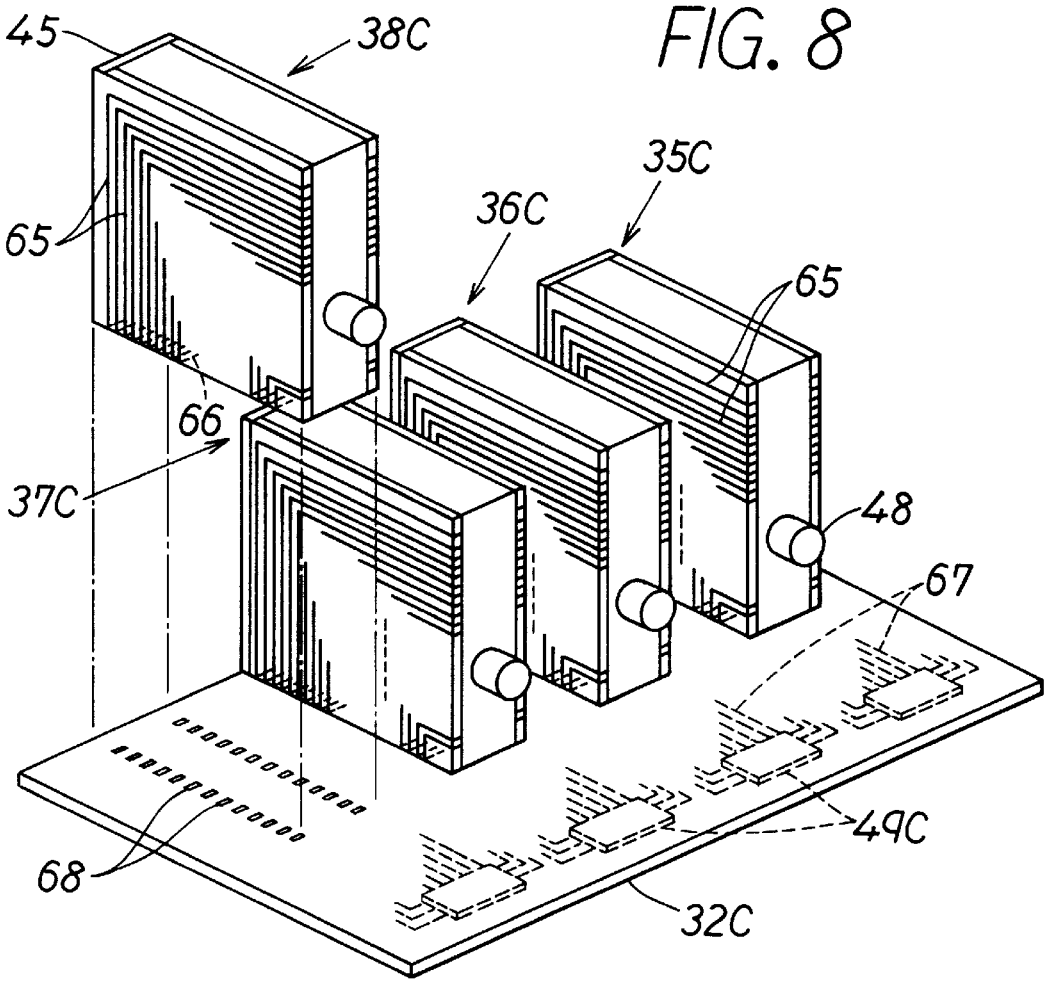
FIG. 8 is a perspective view showing a printer head and a printed circuit plate according to a further modification of the first embodiment.

(C) The first embodiment may be modified still further in that, as shown in FIG. 8, four printer heads 35C through 38C are mounted on a printed circuit plate 32C through respective bottom surfaces which are at right angles to nozzle plates 45. That is, the nozzle plates 45 are held not parallel with but perpendicularly to the printed circuit plate 32C. A number of leading lines 65 are formed on each side surface of the printer heads 35C through 38C in L-shape and have respective connecting terminals 66 at the lowest or bottom surfaces. For respectively driving the printer heads 35C through 38C, four driving ICs 49C are mounted on the printed circuit plate 32C and a number of connecting terminals 68 of wiring patterns 67 are formed on the printed circuit plate 32C in correspondence with the connecting terminals 66. The printer heads 35C through 38C may be fixed to the printed circuit plate 32C by an adhesive or by brazing.

Figure 9:
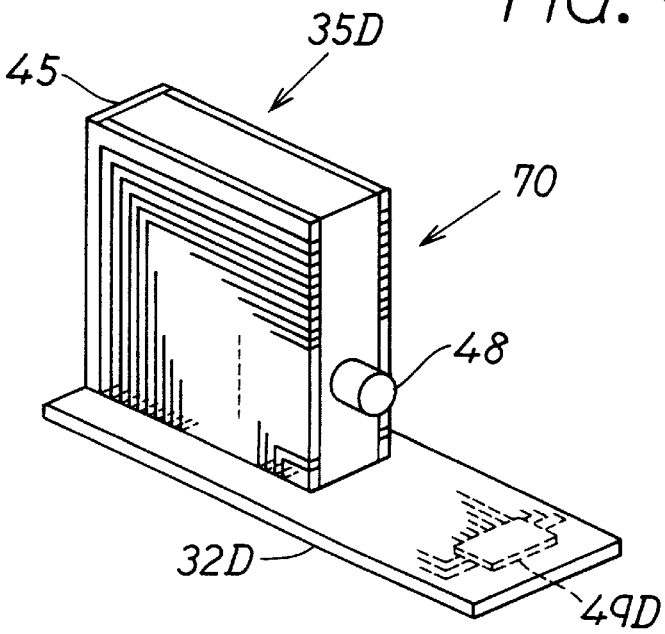
FIG. 9 is a perspective view showing a printer head and a printed circuit plate according to a still further modification of the first embodiment.
Figure 10:
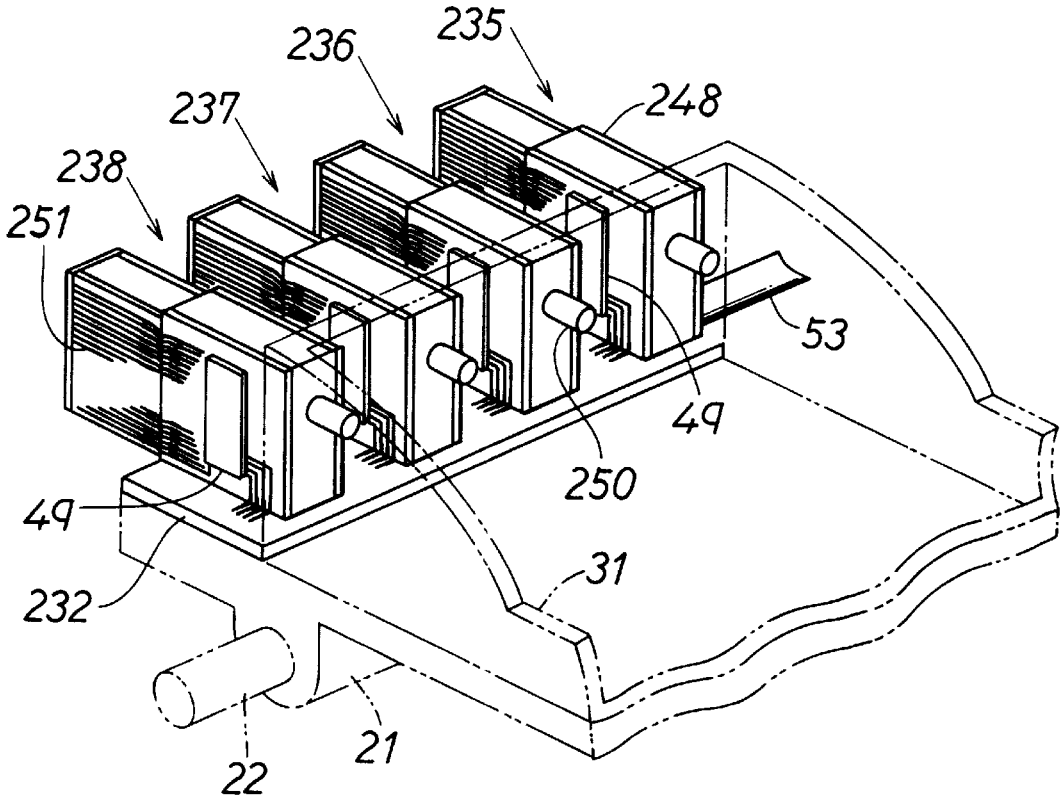
FIG. 10 is a perspective view showing a printer head, a printed circuit plate and a carriage according to a second embodiment of the present invention.
Figure 11:
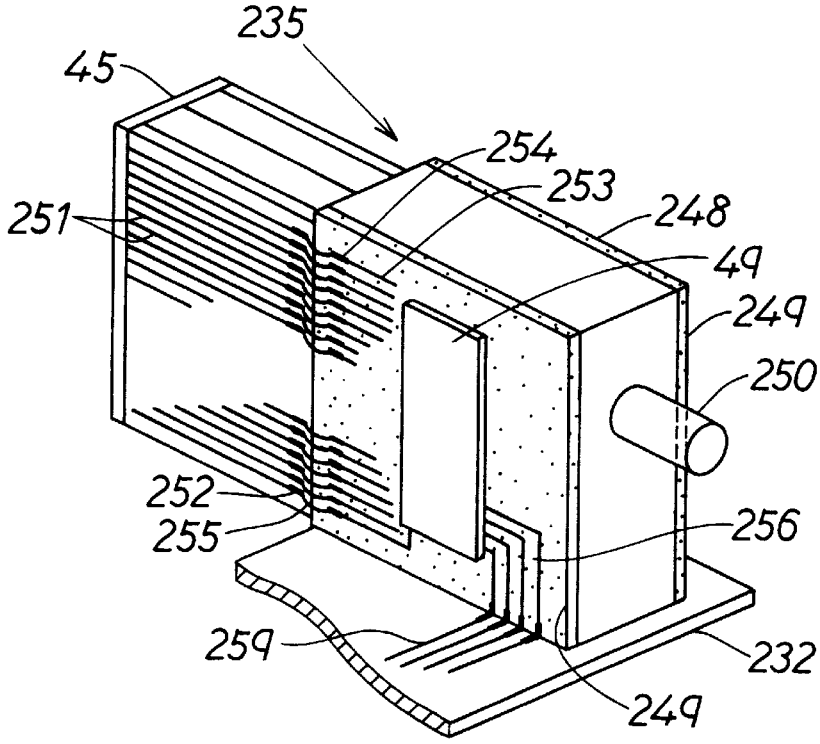
FIG. 11 is a perspective view showing in enlargement a part of the construction shown in FIG. 10.

(D) The first embodiment may be modified still further in that, as shown in FIG. 9, a printer head unit 70 is provided for each ink color so that the number of the printer head unit 70 may be selected in accordance with the number of colors to be used for colored printing. Each unit has a printer head 35D and a small printed circuit plate 32D on which a driving IC 49D is mounted and formed with a wiring pattern for connection with the printer head 35D. This construction will enable the replacement or exchange of the printer head unit 70 from color to color.

Second Embodiment

Figure 12:
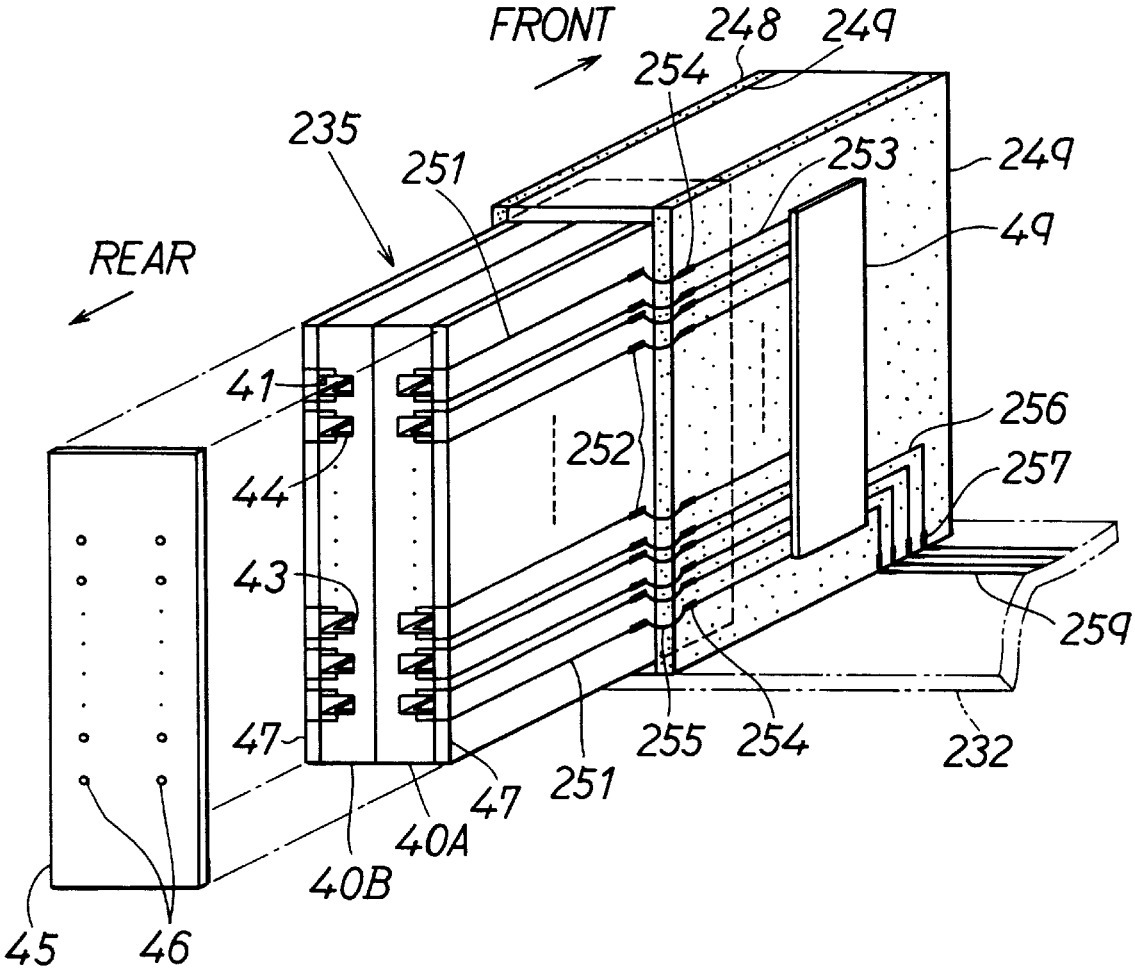
FIG. 12 is a perspective view showing an opposite side of the construction shown in FIG. 11.
Figure 13:
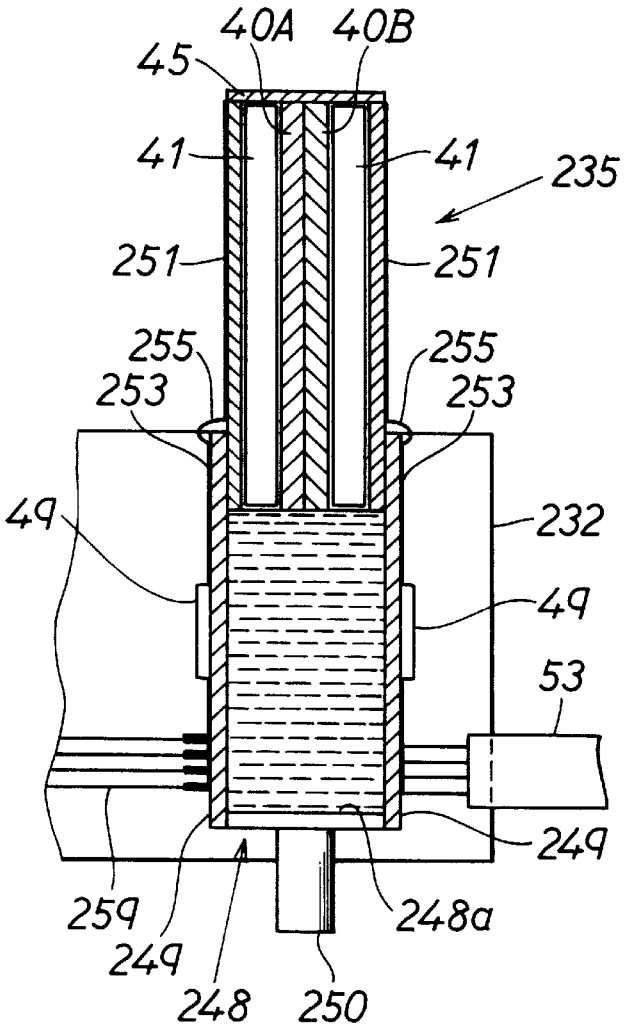
FIG. 13 is a horizontal cross sectional view of the construction shown in FIG. 11.

In the second embodiment shown in FIGS. 10 through 13, a printed circuit plate 232 is carried on the carriage 21 perpendicularly to the paper P. Each of printer heads 235 through 238 has a base plate constructed by stacking a pair of plates 40A and 40B as shown in FIGS. 12 and 13. Each printer head has narrow grooves 41, partition walls 42, ink passages 43, electrodes 44, nozzle plate 45 and cover plates 47 in the same manner as in the first embodiment. In each printer head, a manifold 248 is formed in a box-shape having an ink chamber 248a therein and an opening through which the printer head 235 is fitted. The manifold 248 is generally made of a synthetic resin except for the right and the left side walls (walls in parallel with the row of the ink passages 43) 249 which are made of a ceramics material such as an alumina having a good thermal conductivity. The manifold 248 has an ink inlet pipe 250 at the opposite side of its opening so that the ink in the corresponding ink cartridge may be introduced into the ink chamber 248a therethrough. The front side of the actuator unit having the base plates 40A, 40B and the cover plates 47 are fitted halfway into the manifold 248 through the opening and fixed by an adhesive.

The driving IC 49 is mounted on each side wall 249 of the manifold 248 to drive the ink jetting operation of the corresponding row of the ink chambers. A number of the leading electrodes 251 connected to the corresponding electrodes 44 are formed on both cover plates 47 to extend in parallel to each other and have respective connecting terminals (head-side terminals) 252 near the opening of the manifold 249. Similarly, a number of leading electrodes 253 connected to the outputs of the driving IC 49 are formed by etching or screen printing are formed on both side walls 249 and have respective connecting terminals (manifold-side terminals) 254 in correspondence with the connecting terminals 252. The connecting terminals 252 and 254 are connected by wire bonding 255.

Leading electrodes 256 connected to the input side of the driving IC 49, less in number than the leading electrodes 251 at the output side, are formed in an L-shape on the side walls 249 of the manifold 248 and have respective connecting terminals 257. The printed circuit plate 232 is connected to the FPC (not shown) which is in turn connected to the printer control circuit (not shown) in the same manner as in the first embodiment. The printed circuit plate 232 has a wiring pattern 259 including the clock line, data line, voltage supply line and ground line and connected to the connecting terminals 257 by brazing.

The manifold 248 is joined to the printed circuit plate 232 at its bottom surface which is perpendicular to the nozzle plate 45.

In this embodiment as well, as the driving IC 49 and the leading electrodes 251, 253, 256 having respective terminals 252, 254, 257 are mounted and formed on the side walls 249 of the manifold 248, the same or similar operation and advantages are provided as in the first embodiment. Further, as the side walls 249 are made of a ceramics material and the leading electrodes 253, 256 are provided thereon with the driving IC 49 in particular, the leading electrodes 253, 256 may be formed assuredly thereon by the etching or the screen printing. In addition, the heat of the driving IC 49 may be dissipated effectively to the ink in the ink chamber 35a through the side walls 249 which are thermally conductive. The ink is thus heated to have a lower viscosity which will improve ink jetting performance.

(Modification of the Second Embodiment)

Figure 14:
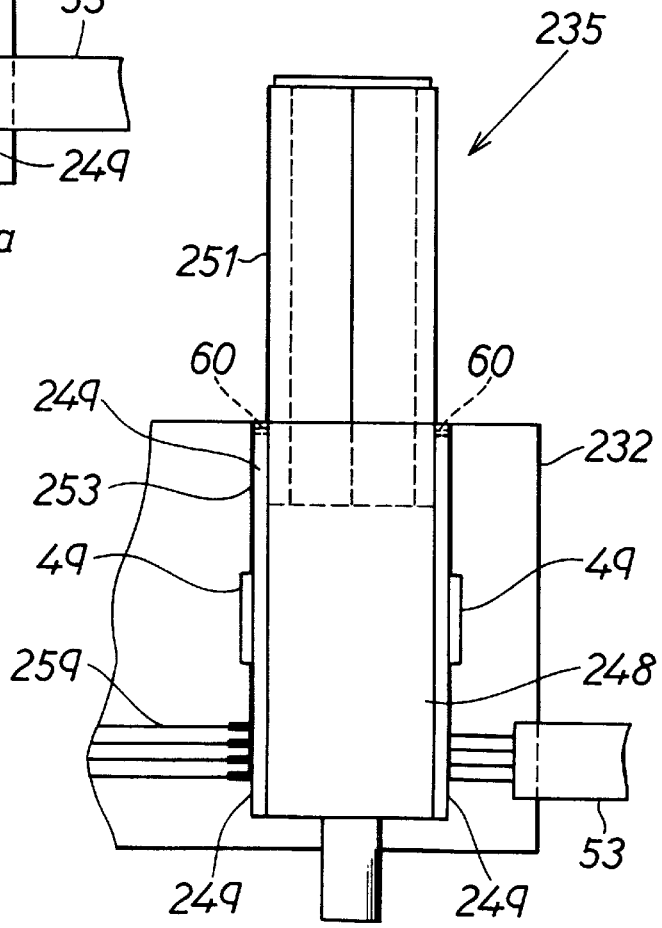
FIG. 14 is a plan view showing a printer head and a printed circuit plate according to a modification of the second embodiment of the present invention.

The second embodiment may be modified in that the printed circuit plate 232 is placed in front of the manifold 248 and in parallel with the nozzle plate 45. Further, as shown in FIG. 14, the connecting terminals of the leading electrodes 251 and 253 may be connected directly via through holes 60 formed on the side walls 24 or connected by brazing using a solder.

Third Embodiment

Figure 15:
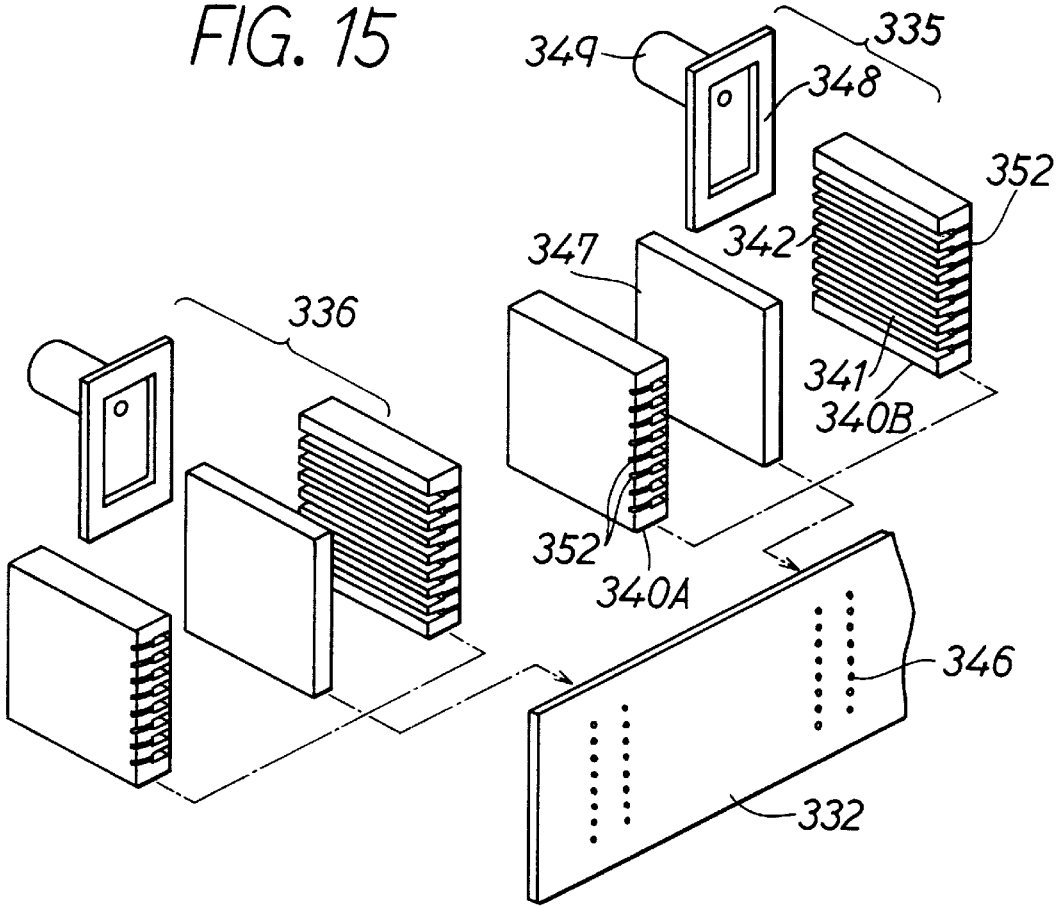
FIG. 15 is a perspective view showing in explosion a printer head and a printed circuit plate according to the third embodiment of the present invention.
Figure 16:
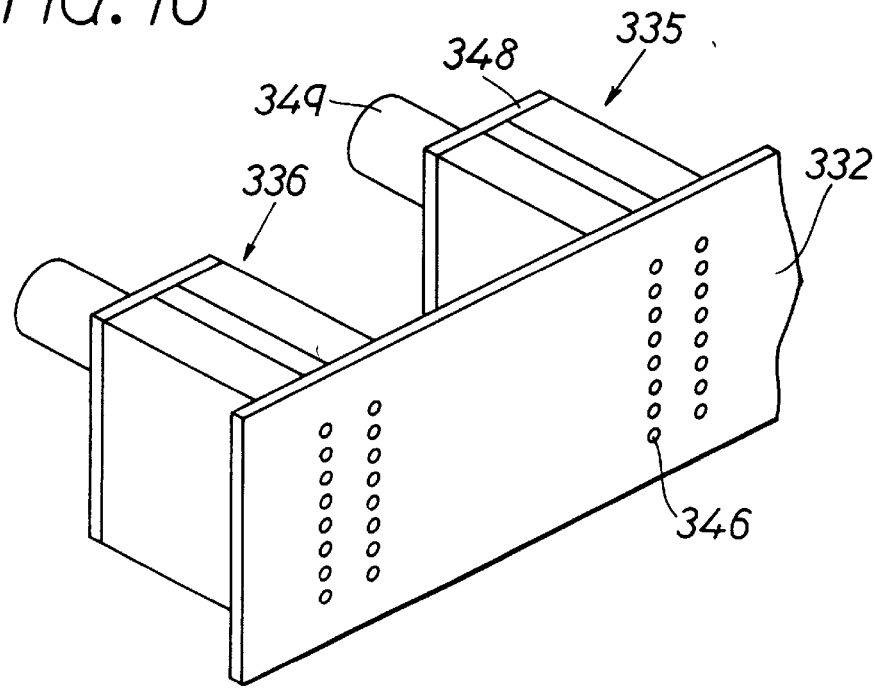
FIG. 16 is a perspective view showing an assembly of parts shown in FIG. 15.

In this embodiment shown in FIGS. 15 through 18, in which only two printer heads 335 and 336 are illustrated exemplarily, each printer head or actuator unit 335 or 336 has a pair of base plates 340A and 340B which are stacked on both sides of a cover plate 347 so that, as shown in FIG. 15, respective rows of narrow grooves 341 are located adjacent to the cover plate 347. A manifold 348 is attached to one side of each actuator unit 335 to introduce the ink from the corresponding ink cartridge through an inlet pipe 349 and distributes into the ink passages.

A printed circuit plate 332 is used as a nozzle plate as well. That is, the printed circuit plate 332 has a number of holes as nozzles 346 in correspondence with the ink passages of each actuator unit. The nozzles 346 for all the actuator units 335 and 336 are provided on the single printed circuit plate 332. According to this arrangement, the relative position of the nozzles 346 for one actuator unit 335 against the nozzles 346 of another actuator unit 336 is determined accurately irrespective of the relative positions between the actuator units 335 and 336, thus enabling the jetting of each color ink for a multi-color printing accurately onto the desired position on the paper.

Figure 17:
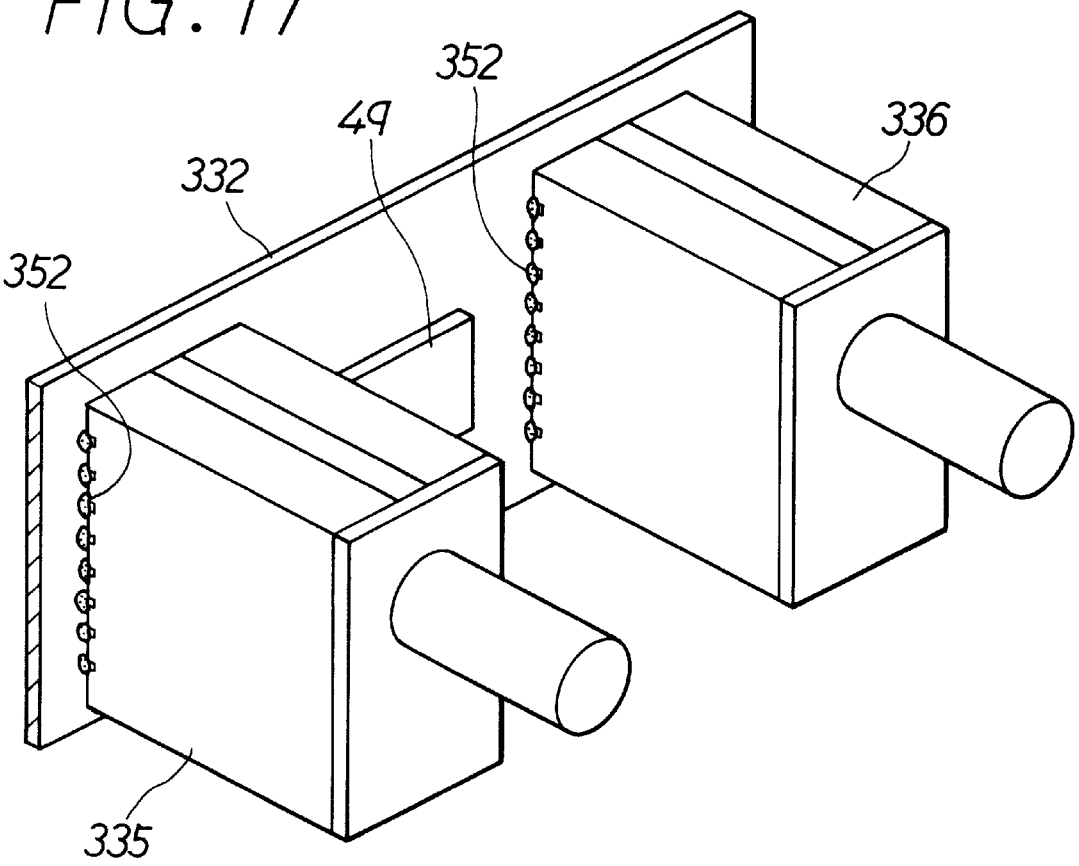
FIG. 17 is a perspective view showing the opposite side of the construction shown in FIG. 16.
Figure 18:
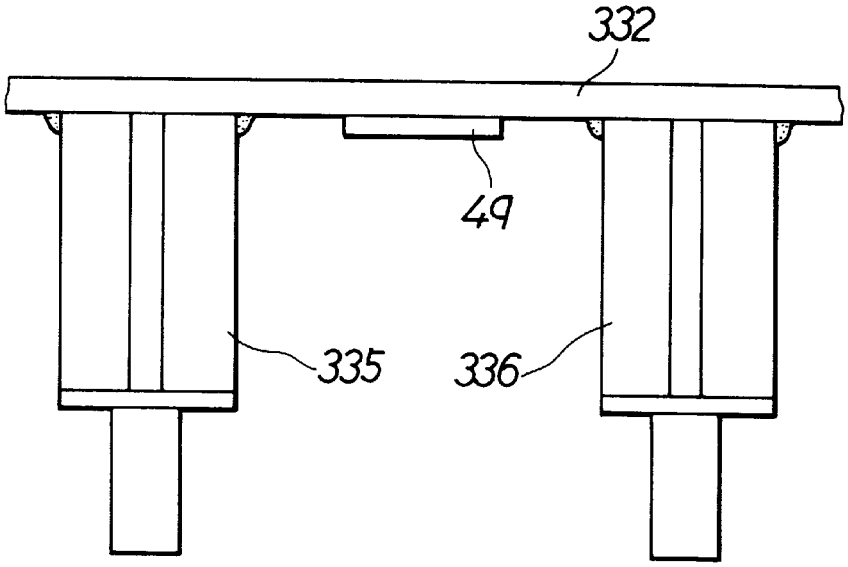
FIG. 18 is a horizontal cross sectional view showing the construction shown in FIG. 16.

As shown in FIGS. 17 and 18, the driving IC 49 is mounted together with its associated input and output leading electrodes (not shown) on the same side of the printed circuit plate 332 as the side the actuator units 335 and 336 are attached to. The electrodes in the narrow grooves of each actuator unit have respective connecting terminals 352 which are exposed outside the actuator unit 335, 336. The actuator units 335 and 336 are attached to the printed circuit plate 332 with the connecting terminals 352 of the actuator units 335 and 336 being brazed to corresponding connecting terminals on the printed circuit plate 332.

The printed circuit plate 332 is preferably made of a ceramics material such as a glass or alumina because of its good heat-resisting property and machinability for nozzles 346. alternatively, various synthetic resins may be used in place of the ceramics material.

Fourth Embodiment

Figure 19:
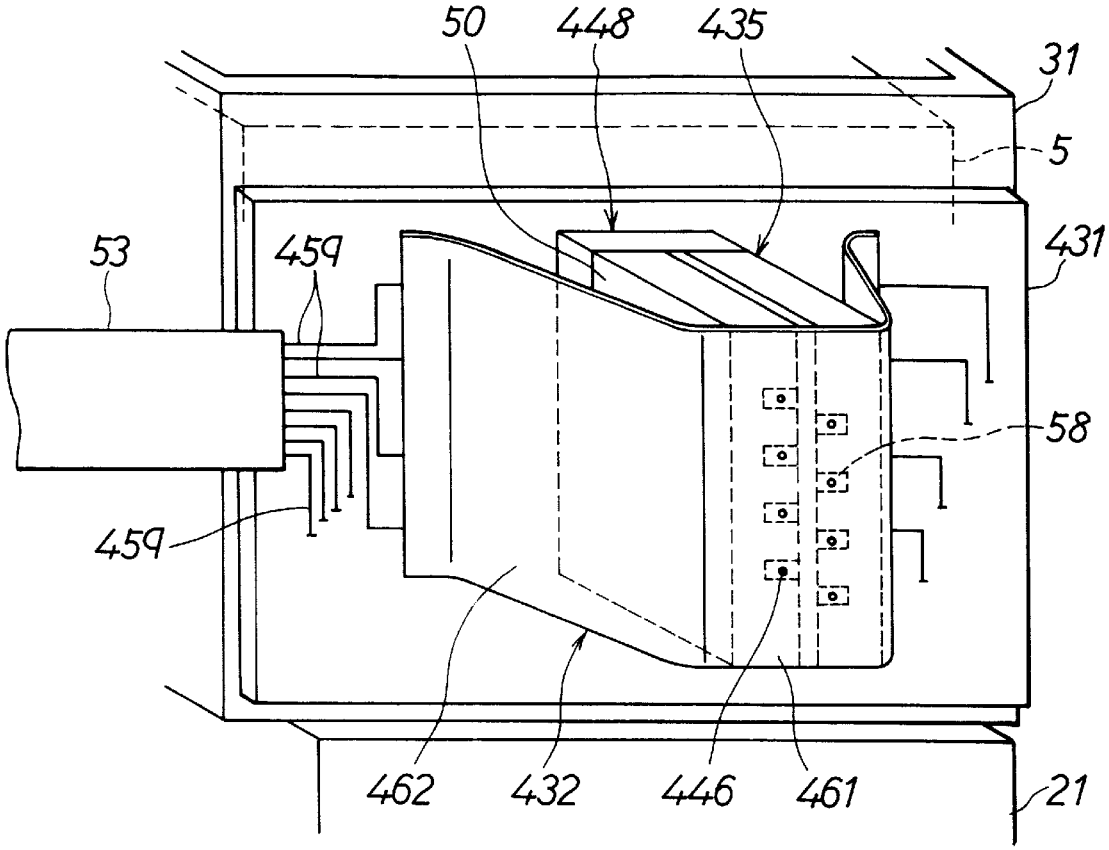
FIG. 19 is a perspective view showing a printer head, a printed circuit plate and a carriage according to the fourth embodiment of the present invention.
Figure 20:
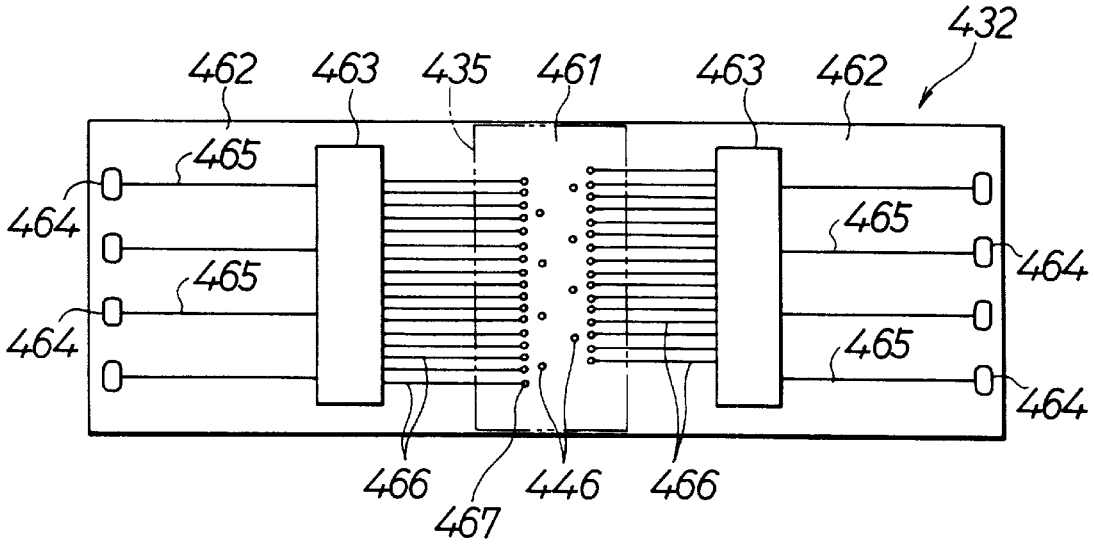
FIG. 20 is a plan view showing the printed circuit plate shown in FIG. 19.

In the fourth embodiment, as shown in FIGS. 19 and 20, a printer head 435 has the similar construction as the printer head 335 in the third embodiment. A printed circuit sheet 432 formed with a number of nozzles 446 therein is made of a flexible material. The connecting terminals on the printer head 435 and the printed circuit sheet 432 are brazed to each other in the similar manner as in the third embodiment.

As shown in FIG. 20 in particular, the printed circuit sheet 432 has a nozzle plate part 461 which faces the printer head 435 as well as extended parts 462 extending sidewise or laterally from the nozzle plate part 461. The nozzle plate part 461 has a number of nozzles 446 which communicates with the corresponding ink passages of the printer head 435, while each extended part 462 has a driving IC 463 and its input and output leading electrodes or wiring patterns 465 and 466 thereon. The output-side wiring patterns 466 have respective connecting terminals 467 which are connected to the corresponding connecting terminals of the printer head 435.

The printer head 435 is fixedly attached to another printed circuit plate 431 at the side opposite to the flexible printed circuit sheet 432. The printed circuit plate 431 has a sufficient rigidity and mounted onto the head holder 31 on the carriage 21. The flexible printed circuit sheet 432 is fixedly joined to the rigid printed circuit plate 431 at both ends thereof with its connecting terminals 464 of the leading electrodes 465 being connected to corresponding leading electrodes 459 formed on the printed circuit plate 431. The leading electrodes 459 are connected to the printer control circuit (not shown) through the FPC 53. Alternatively, one lateral side of the flexible printed circuit sheet 432 may be extended to be connected directly to the printer control circuit thus eliminating the FPC 53.

According to this embodiment, the flexible printed circuit sheet 432 used as the nozzle plate as well reduces the number of component parts and enables reduction in size. Further, it may be bent and positioned arbitrarily not to impede the movement of the paper and may be arranged at a location suitable for the connection with the printer control circuit.

Fifth Embodiment

Figure 21:
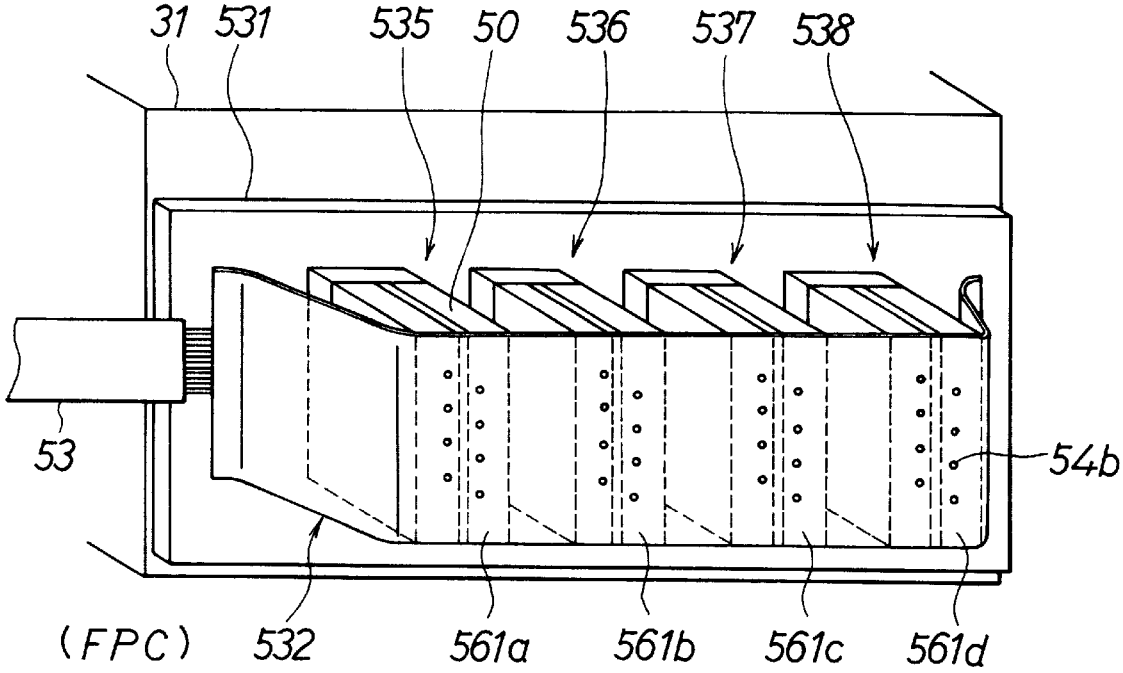
FIG. 21 is a perspective view showing a printer head, a printed circuit plate and a carriage according to the fifth embodiment of the present invention.
Figure 22:
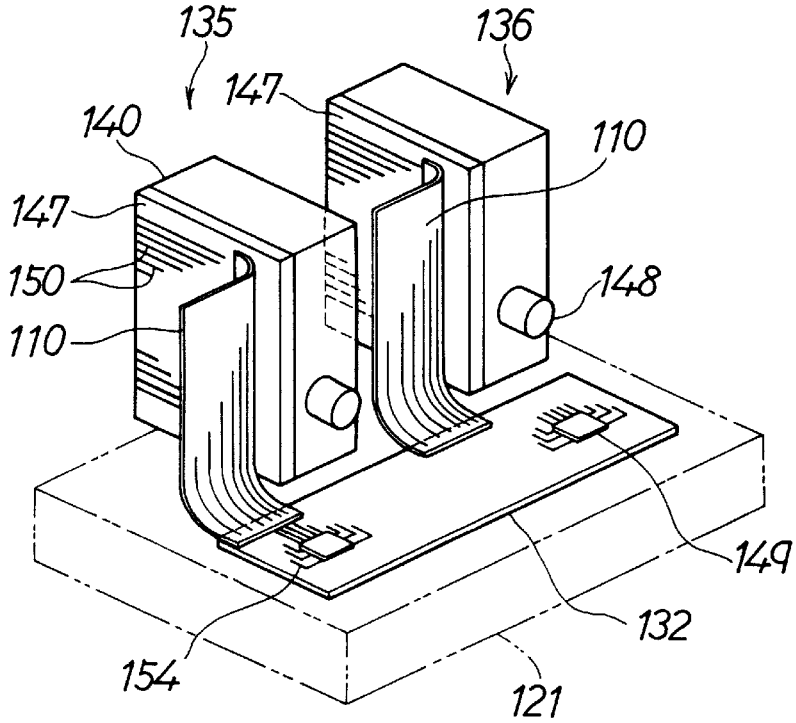
FIG. 22 PRIOR ART
FIG. 22 is a perspective view showing a printer head and a printed circuit plate according to a conventional device.

In this embodiment, as shown in FIG. 21, a printed circuit plate 532 in the form of a flexible sheet has a plurality of nozzle plate parts 561*a* through 561d in correspondence with a plurality of printer heads 535 through 538. The printer heads 535 through 538 are fixedly mounted on the single rigid printed circuit plate 531. A driving ICs and associated wiring patterns are provided on the flexible printed circuit sheet 532 similarly as in the fourth embodiment.

The present invention should not be limited to the above-described embodiments and modifications but may be implemented in various other ways without departing from the spirit and scope of the invention, including its application to a type in which the ink jetting pressure is generated by heating the ink to evaporate, a type in which ink jetting nozzles are directed downward or inclined, and a type in which a printer head unit is constructed laterally to cover the full paper width and is carried by a carriage.

What is claimed is:

1. An ink jet-type printer device, comprising:

at least one printer head, each printer head including a plurality of ink passages and a plurality of actuators for jetting ink in the ink passages;

a printed circuit plate mounting thereon the at least one printer head;

a carriage for carrying the at least one printer head and the printed circuit plate integrally;

connecting terminals, provided on each printer head of the at least one printer head for supplying electrical signals to the plurality of actuators of each printer head, each of the actuators including a polarized piezoelectric element which deforms to apply a jetting pressure to the ink by a voltage applied thereto in response to a supplied electrical signal; and a wiring pattern provided on the printed circuit plate and having connecting terminals which correspond in number and location to the connecting terminals of each printer head of the at least one printer head for supplying electric signals to the connecting terminals of each printer head, the corresponding connecting terminals on the printed circuit plate and the connecting terminals for each printer head contacting one another when the printer head is mounted to the printed circuit plate to supply the electric signals from the printed circuit plate to the printer head, wherein the printed circuit plate is a nozzle plate for the printer head.

2. The ink jet-type printer device according to claim 1, wherein the at least one printer head is one of a plurality of printer heads and the wiring pattern is a plurality of individual wiring patterns on the printed circuit plate, each individual wiring pattern associated with one printer head of the plurality of printer heads.

3. The ink jet-type printer device according to claim 2, wherein each printer head has a first side surface in parallel with a first row of the plurality of actuators, and has a second side surface arranged in parallel with an adjacent second row of the plurality of actuators with the second side surface thereof being held in parallel with that of the first side surface, and the connecting terminals of the printer head are provided on at least one of the first side surface and the second side surface.

4. The ink jet-type printer device according to claim 2, wherein each printer head has a plurality of ink jetting nozzles opening at ends of and communicating with the plurality of the ink passages, and the connecting terminals of the printer head are provided on a side surface of the printer head and held in contact with the connecting terminals of the individual wiring pattern of the printed circuit plate.

5. The ink jet-type device according to claim 2, wherein each printer head of the plurality of printer heads has a pair of side surfaces in parallel with a row of the plurality of actuators and the plurality of printer heads have respective side surfaces in parallel to one another.

6. The ink jet-type printer device according to claim 1, wherein the printed circuit plate has a plurality of ink jetting nozzles, and the printer head is attached to the printed circuit plate with the plurality of ink jetting nozzles being aligned with the plurality of ink passages and with the connecting terminals of the printer head corresponding to the connecting terminals of the printed circuit pattern.

7. The ink jet-type printer device according to claim 6, wherein the printed circuit plate is made of a ceramic material.

8. The ink jet-type printer device according to claim 6, wherein the printed circuit plate is made of a flexible sheet.

9. The ink jet-type printer device according to claim 1, further comprising:

a driving circuit, mounted on the printed circuit plate, for producing the electric signals and selectively driving the plurality of actuators by the electric signals applied through the connecting terminals of the printer head and the printed circuit plate.

10. The ink jet-type printer device according to claim 1, wherein the actuators partly define the ink passages and the ink passages change in capacity when the actuators deform.

11. An ink jet-type printer head assembly, comprising:

at least one printer head, each printer head of the at least one printer head including a plurality of ink passages and a plurality of actuators for jetting ink in the ink passages;

a driving circuit for each printer head of the at least one printer head for selectively driving the plurality of actuators in response to a data signal applied thereto, each actuator of the plurality of actuators including a polarized piezoelectric element which deforms to apply a jetting pressure to the ink by a voltage applied according to the data signal; and a printed circuit plate having a wiring pattern thereon including at least a leading electrode of the data signal, the printed circuit plate supporting thereon the at least one printer head, wherein each printer head of the at least one printer head has connecting terminals for driving the plurality of actuators, the printed circuit plate has connecting terminals connected to the wiring pattern, and the connecting terminals of each printer head being located in correspondence with the connecting terminals of the printed circuit plate, the corresponding connecting terminals on the printed circuit plate and the connecting terminals for each printer head contacting one another when the printer head is mounted to the printed circuit plate to supply the data signals from the printed circuit plate to the printer head, wherein the printed circuit plate is a nozzle plate for the printer head.

12. The ink jet-type printer head assembly according to claim 11, wherein the driving circuit for each printer head is mounted on the printed circuit plate and connected to the wiring pattern of the printed circuit.

13. The ink jet-type head assembly according to claim 11, wherein each printer head of the at least one printer head stores ink different in color from another printer head of the at least one printer head.

14. The ink jet-type printer head assembly according to claim 11, wherein the connecting terminals of the printer head and the printed circuit plate are brazed through a brazing material which melts at a temperature lower than the Curie point of the piezoelectric element.

15. The ink jet-type printer head assembly according to claim 14, wherein the brazing material is attached to one of the connecting terminals of the printer head and the printed circuit plate and is heated to the temperature to melt.

16. The ink jet-type head assembly according to claim 11, wherein the actuators partly define the ink passages and the ink passages change in capacity when the actuators deform.

17. The ink jet-type printer head assembly according to claim 11, wherein the at least one printer head comprises a plurality of printer heads and each printer head of the plurality of printer heads has a pair of side surfaces in parallel with a row of the plurality of actuators and the plurality of printer heads have respective side surfaces in parallel to one another.

18. The ink jet-type printer head assembly according to claim 11, wherein the printed circuit plate has a plurality of ink jetting nozzles, and the at least one printer head is attached to the printed circuit plate with the plurality of ink jetting nozzles being aligned with the plurality of ink passages of each printer head.

* * * * *